US006773311B2

(12) United States Patent
Mello et al.

(10) Patent No.: US 6,773,311 B2
(45) Date of Patent: Aug. 10, 2004

(54) ELECTRICAL SPLICE CONNECTOR

(75) Inventors: Keith F. Mello, Manchester, NH (US); Richard Chadbourne, Merrimack, NH (US); Daniel D. Dobrinski, Hillsborough, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/068,178

(22) Filed: Feb. 6, 2002

(65) Prior Publication Data

US 2003/0148671 A1 Aug. 7, 2003

(51) Int. Cl.[7] ..... H01R 4/50; H01R 11/01
(52) U.S. Cl. ..... 439/783; 439/863
(58) Field of Search ..... 439/796, 790, 439/783, 786, 863

(56) References Cited

U.S. PATENT DOCUMENTS

| | | | | |
|---|---|---|---|---|
| 414,362 A | | 11/1889 | Anderson | |
| 1,657,970 A | | 1/1928 | Ercole | |
| 3,205,300 A | | 9/1965 | Becker | |
| 3,384,704 A | | 5/1968 | Vockroth | |
| 4,066,368 A | | 1/1978 | Mastalski et al. | 403/211 |
| 4,362,352 A | | 12/1982 | Hawkins et al. | 339/248 |
| 4,428,100 A | | 1/1984 | Apperson | 24/115 R |
| 4,451,104 A | | 5/1984 | Hodgson et al. | |
| 4,698,031 A | | 10/1987 | Dawson | 439/863 |
| 4,857,020 A | * | 8/1989 | Crosby | 439/783 |
| 4,863,403 A | | 9/1989 | Shannon | |
| 5,044,996 A | | 9/1991 | Goto | 439/783 |
| 5,278,353 A | | 1/1994 | Buchholz et al. | 174/84 R |
| 5,683,273 A | | 11/1997 | Garver et al. | 439/784 |
| 6,068,525 A | | 5/2000 | De Keyser | |
| 6,193,565 B1 | | 2/2001 | Herron | 439/783 |

FOREIGN PATENT DOCUMENTS

GB 858703 A 1/1961

OTHER PUBLICATIONS

Mello et al., (US 2002/0119710 A1) Electrical Connector Having Frame and Slidable Members, Aug. 29, 2002.*

* cited by examiner

*Primary Examiner*—Chandrika Prasad
(74) *Attorney, Agent, or Firm*—Harrington & Smith, LLP

(57) ABSTRACT

An electrical conductor splice connector including a body; conductor contacting wedges movably mounted on the body; and at least one wedge movement anti-reverse clip connected to the body and contacting one of the wedges. The anti-reversing clip includes an anti-reversing tab, a removal tab, a notch therebetween, and a wedge stop tab for limiting reward movement of the wedges on the body.

37 Claims, 5 Drawing Sheets

ELECTRICAL SPLICE CONNECTOR

BACKGROUND OF THE INVENTION

1. Field of the Invention

The present invention relates to electrical splices and, more particularly, to an electrical splice connector and method of forming a splice of electrical conductors.

2. Brief Description of Prior Developments

Electrical splice connectors for connecting ends of electrical conductors to each other are well known in the art. U.S. Pat. No. 3,205,300 discloses one type of a splice which comprises pairs of wedge shaped gripping members. U.S. Pat. No. 6,193,565 discloses another type of splicing connector which comprises substantially open lateral sides. There is a desire to provide an improved electrical conductor splice connector which is easier to manufacture and assemble than conventional connectors, but also allows for open side loading of conductors into the connector. There is also a desire to provide an anti-reversing movement function to movement of wedges in the connector. There is also a desire to provide the ability to overcome an anti-reversing movement function. There is also a desire to provide a splicing connector as a singular unit such that components of the connector do not become inadvertently separated from each other before connection to the conductors.

SUMMARY OF THE INVENTION

In accordance with one aspect of the present invention, an electrical conductor splice connector is provided comprising a body; conductor contacting wedges movably mounted on the body; and at least one wedge movement anti-reverse clip connected to the body and contacting one of the wedges.

In accordance with another aspect of the present invention, an electrical conductor splice connector is provided comprising a body; and a pair of opposing conductor contacting wedges having bottom surfaces and outer lateral side surfaces slidably located on the body. A first one of the wedges comprises a cantilevered bar at a top portion of the first wedge which slidably extends into a receiving area of a second one of the wedges to interlock forward and reward movement of the pair of wedges with each other.

In accordance with another aspect of the present invention, an electrical conductor splice connector is provided comprising a body; and a pair of interlocked opposing conductor contacting wedges slidably located on the body. The body comprises wedge grooves. The wedges comprise protrusions slidably located in the wedge grooves. At least one of the wedge grooves comprises a main section and an initial mounting portion located inwardly relative to the main section. During locating of the pair of wedges on the body the protrusion must be located in the initial mounting portion of the wedge groove before the protrusion can be moved into the main section of the wedge groove.

In accordance with one method of the present invention, a method of assembling an electrical conductor splice connector is provided comprising steps of inserting a wedge into a wedge receiving area of a splice connector body; and connecting an anti-reversing clip to a top side of the splice connector body, the clip having an anti-reverse tab which projects inward into the wedge receiving area and into contact with the wedge.

In accordance with another method of the present invention, a method of assembling an electrical conductor splice connector is provided comprising steps of inserting a pair of conductor contacting wedges into a wedge receiving area of a splice connector body, the wedges having projections which are inserted into initial mounting portions of grooves in the body and subsequently moved into main sections of the grooves; and connecting a clip to the splice connector body, the clip forming a direct barrier to movement of at least one of the wedges such that the projections are prevented from moving back into the initial mounting portions of the grooves and becoming inadvertently disconnected from the splice connector body.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
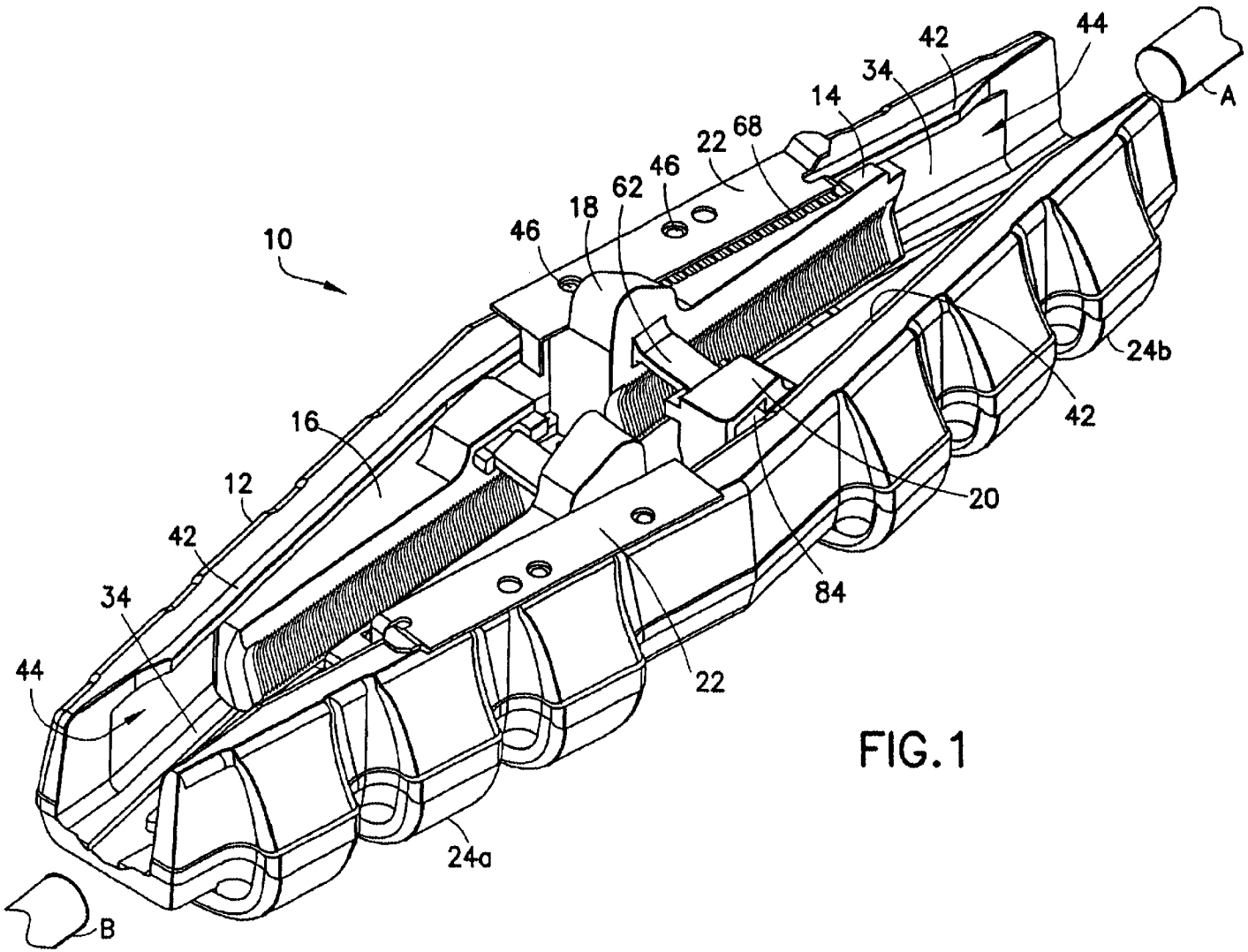
FIG. 1 is a perspective view of an electrical conductor splice connector incorporating features of the present invention.

Referring to FIG. 1, there is shown a perspective view of an electrical conductor splice connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The connector 10 generally comprises a body 12, two pairs 14, 16 of conductor contacting wedges 18, 20, and two wedge movement anti-reverse clips 22. In alternate embodiments, the connector 10 could comprise additional or alternative components. The connector 10 is generally adapted to fixedly and electrically connect two conductors A, B to each other. In alternate embodiments, the connector 10 could be adapted to attach more than two conductors to each other.

Figure 2:
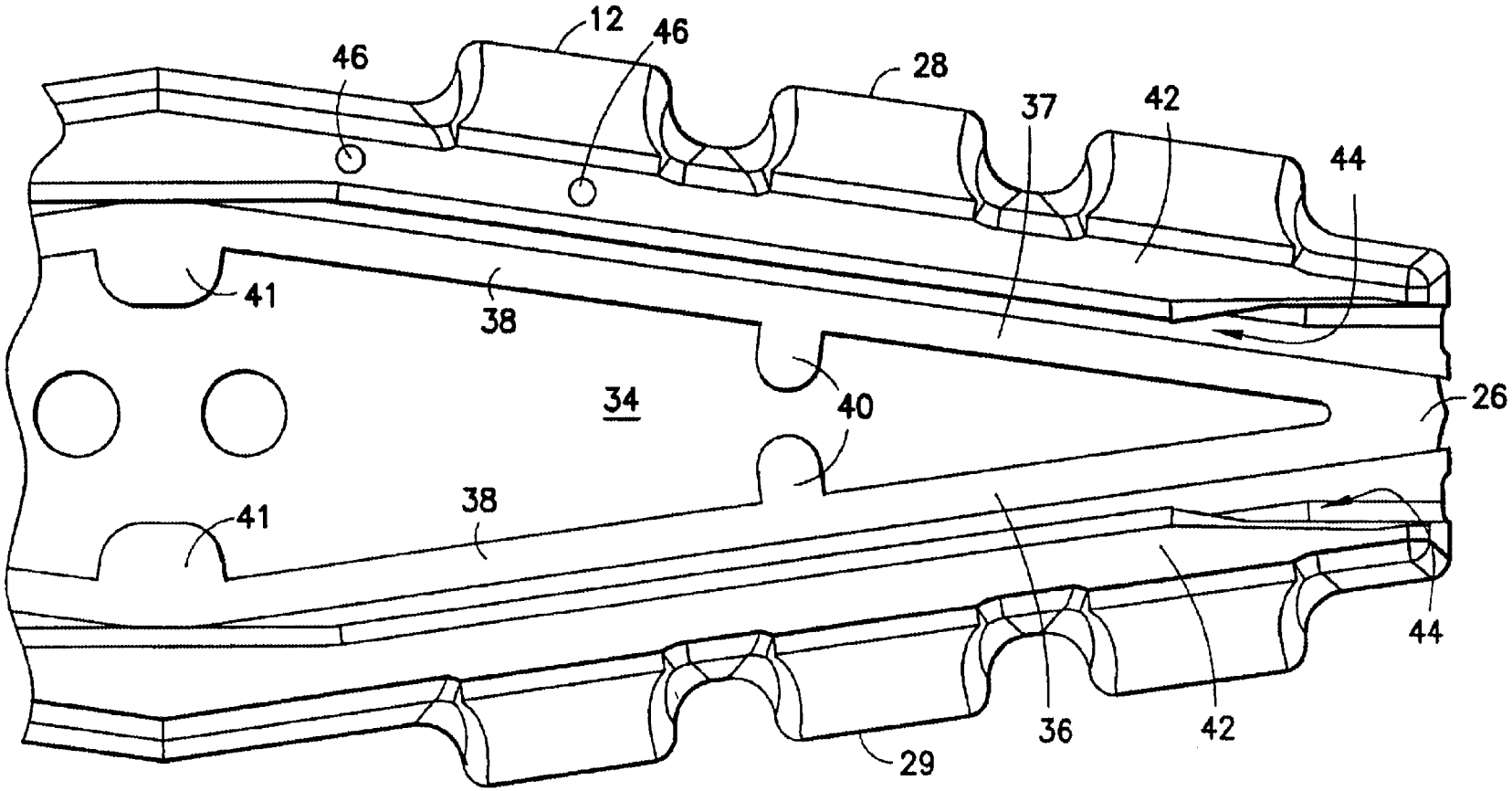
FIG. 2 is a partial top plan view of one end of the body of the connector shown in FIG. 1.

The body 12 generally comprises a one-piece frame member. However, in alternate embodiments, the body 12 could be comprised of more than one frame member. The body or frame 12 is preferably comprised of metal with a general C shaped cross section. The general C shape allows conductors A, B to be inserted into the connector 10 through the substantially open top side of the connector. However, in alternate embodiments, the frame member 12 could be comprised of any suitable type of material(s). In addition, the frame 12 could have any suitable type of shape. Referring also to FIG. 2, the frame member 12 comprises two opposite ends or sides 24*a*, 24*b*. In the embodiment shown, the two opposite sides 24*a*, 24*b* are substantially mirror images of each other. However, in alternate embodiments, the two opposite sides could have different shapes.

Each side 24*a*, 24*b* comprises a bottom 26 and two lateral sides 28, 29 which forms a receiving area 34 for receiving one of the pairs of wedges 18, 20 and an end of one of the conductors A, B. The bottom 26 comprises a top side which includes two wedge grooves 36, 37. The wedge grooves 36, 37 each comprise a main section 38 and two initial mounting portions 40, 41. In the embodiment shown, the wedge grooves of the two sides 24*a*, 24*b* share the same rear of initial mounting portions 41. However, in alternate embodiments, they might not share the same rear initial mounting portions 41. The two lateral sides 28, 29 have top sections with inwardly projecting ledges 42. This forms channels 44 for slidably receiving outward lateral sides of the wedges 18, 20 in the channels. The top sections of the frame 12 also comprises clip mounting posts 46. However, in alternate embodiments, any suitable means for attaching the clips 22 to the frame 12 could be provided.

Figure 3:
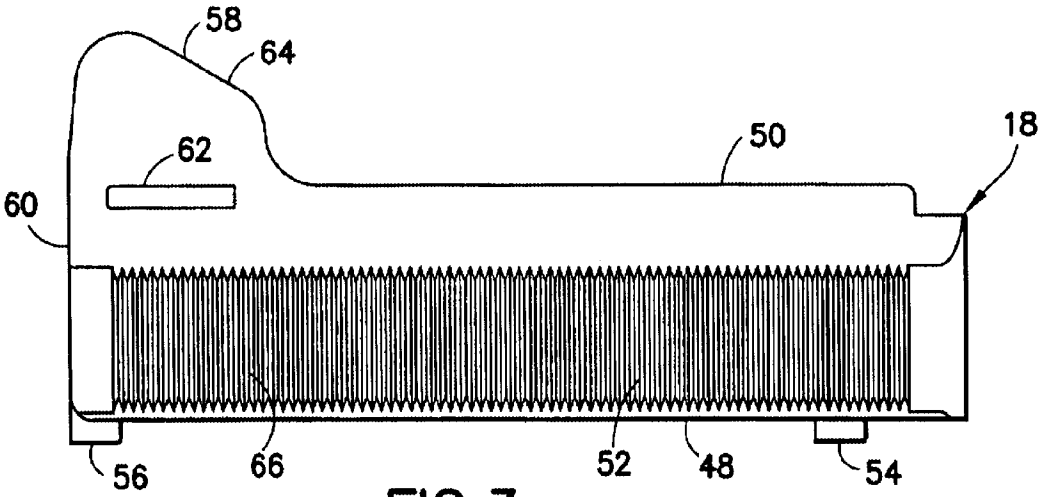
FIG. 3 is a side elevational view of a first one of the conductor contacting wedges shown in FIG. 1.
Figure 4:
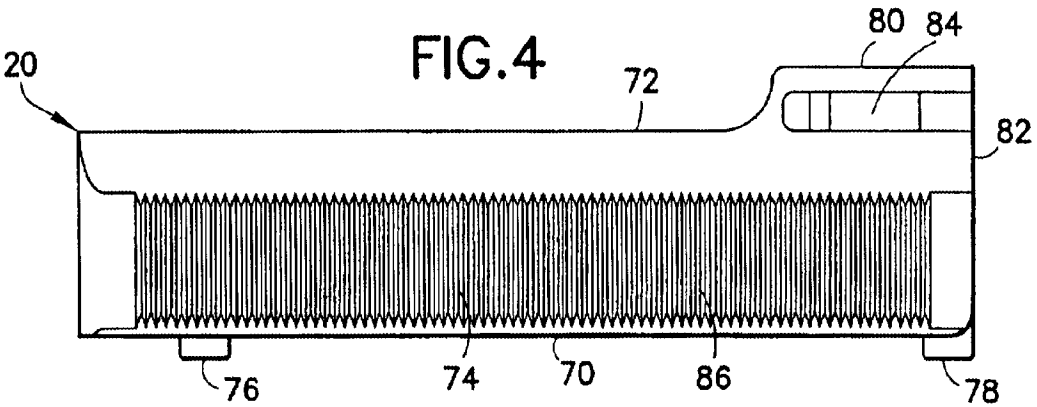
FIG. 4 is a side elevational view of a second one of the conductor contacting wedges shown in FIG. 1 intended to be used with the first conductor contacting wedge shown in FIG. 3.
Figure 5:
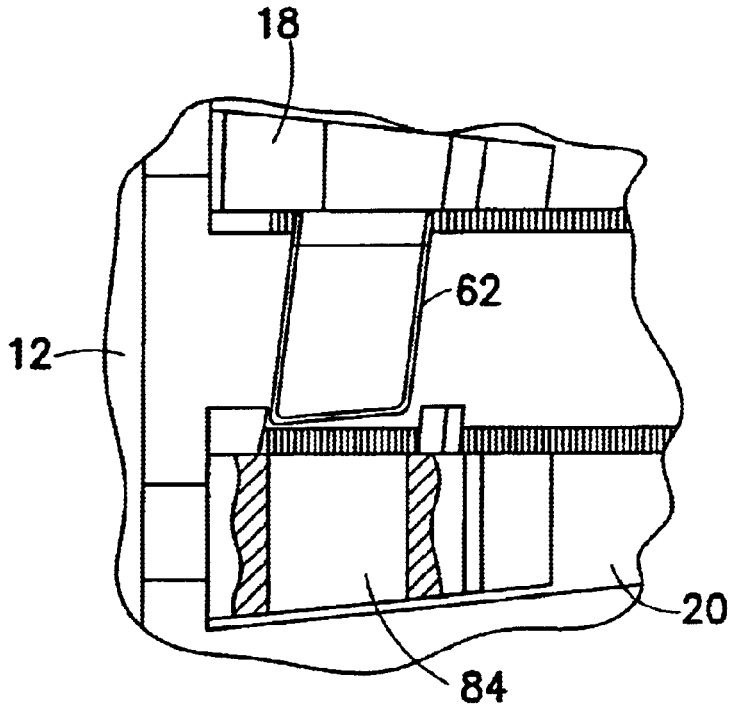
FIG. 5 is a partial top plan view of the rear ends of a pair of the conductor contacting wedges shown in FIG. 1.

Referring now also to FIGS. 3, 4 and 5, one of the pairs 14, 16 of the wedges 18, 20 will be described. In this embodiment, the pairs 14, 16 of wedges are identical to each other; merely being orientated in reverse directions relative to each other. However, in alternate embodiments, the pairs of wedges could be different from each other. In another alternate embodiment, a set of wedges for each conductor A, B could comprise more than two wedges. In another alternate embodiment, one or both sides 24*a*, 24*b* could comprise merely a single wedge rather than a pair of wedges.

Each of the first wedges 18 generally comprise a bottom side 48, a top side 50, an inward facing side 52, and an outward facing side which is located in one of the channels 44. The bottom side 48 comprises two projections 54, 56. In alternate embodiments, the bottom side 48 could comprise more or less than two projections. The top side 50 generally comprises a projection 58 located at a rear end 60 of the wedge 18. The projection 58 forms a wedge retract/advance tab. One function of the tab 58 is that it can be struck with a hammer allowing the installer to advance and retract the wedges 18, 20. The shape of the wedge retract/advance tab is conductive to striking with a hammer, yet streamlined enough so that when the connector is pulled through roller blocks, the wedge retract/advance tabs do not get caught so as to restrict the polling or to cause the conductor to disengage from the wedges. The projection 58 forms a contact surface 64 at its front side. The projection 58 extends out of the receiving area 34 at the top of the frame 12. The contact surface 64 is adapted to be a hit by a tool, such as a hammer, when attempting to remove the wedges from a gripping engagement with one of the conductors A, B. In an alternate embodiment, the projection 58 might not be provided. A portion of the back surface of the tab 58 is straight and perpendicular to the conductor gradations 98*a*–98*c* of the anti-reverse tab 22. This is another function of the tab 58 in that it provides a good indicator that the wedges are in the correct position for the type of conductor installed.

The inward facing side 52 comprises a projection 62 located proximate the projection 58. In the embodiment shown, the projection 62 has a general cantilevered bar shape. However, in alternate embodiments, the projection 62 could have any suitable type of shape. The inward facing side 52 also comprises a separated section 66 forming a gripping surface for gripping onto one of the conductors A, B. In alternate embodiments, any suitable type of gripping surface on the inward facing side 52 could be provided. The gripping surface 66 has a general concave shape to form a conductor groove. The top side 50 also comprises serrations 68 (see FIG. 1) along a majority of its length.

Each of the second wedges 20 generally comprises a bottom side 70, a top side 72, an inward facing side 74, and an outward facing side which is located in one of the channels 44. The bottom side 70 comprises two projections 76, 78. In alternate embodiments, the bottom side 70 could comprise more or less than two projections. The top side 72 generally comprises a projection 80 located proximate its rear end 82. The projection 80 comprises an aperture 84 therein. Referring also to FIG. 5, the aperture 84 is sized and shaped to be able to slidably receive the bar shaped projection 62 of the opposite wedge 18 therein. The inward facing side 74 also comprises a serrated section 86 forming a gripping surface for gripping onto one of the conductors A, B. In alternate embodiments, any suitable type of gripping surface on the inward facing side 74 could be provided. The gripping surface 86 has a general concave shape to form a conductor groove.

In the embodiment shown, in order to mount one of the pairs of wedges 18, 20 to the frame 12, the wedges 18, 20 are mounted to each other in relatively close proximity. The two gripping surfaces 66, 86 face each other. The bar shaped projection 62 extends into the aperture 84. The pair of wedges 18, 20 are then inserted into the receiving area 34. As the wedges 18, 20 are inserted, the front bottom side projections 54, 76 extend into the front initial mounting portions 40 of the grooves 36, 37. Likewise, the rear bottom side projections 56, 78 extend into the rear initial mounting portions 41 of the grooves 36, 37. The wedges 18, 20 are then moved outward relative to each other such that the bottom side projections 54, 56, 76, 78 extended into the main portions 38 of the grooves 36, 37. The wedges 18, 20 are then moved forward towards the outward ends of the grooves 36, 37. This causes a misalignment of the bottom side projections 54, 56, 76, 78 with the initial mounting portions 40, 41 of the grooves 36, 37.

When the wedges 18, 20 are moved outward relative to each other, portions of their top sides 50, 72 are located under the inward projecting ledges 42. With the bottom side projections 54, 56, 76, 78 restrained in the main portions 38 of the grooves 36, 37, and portions of the wedges being constrained in the channels 44 by the inward projecting ledges 42, the wedges 18, 20 are constrained to a sliding movement along the paths of the grooves 36, 37. The grooves 36, 37 are angled relative to each other. As the wedges 18, 20 move towards the outer ends of the frame 12, the gripping surfaces 66, 86 moved towards each other. As the gripping surfaces 66, 86 move towards each other, the wedges 18, 20 are able to grasp onto one of the conductors A, B located between the two wedges.

As noted above, the bar shaped projection 62 is located in the aperture 84. This provides an interlocking engagement between the two wedges 18, 20 of each pair of wedges. This interlocking engagement insurers that the two wedges 18, 20 will move outward and inward relative to the end of the frame 12 in substantial unison with each other. In alternate embodiments, an interlocking engagement between the pair of wedges might not be provided. Alternatively, any suitable type of interlocking engagement between the opposing pair of wedges could be provided.

Regardless of the position of the opposing wedges, the bar projection 62 on the first wedge 18 can preferably always interface with the rectangular hole 84 on the second wedge 20. One purpose of the wedge interlock configuration is that it insures that the wedges always advance and retract at the same rate in relation to each other. The pressure from each of the wedge conductor grooves is always applied symmetrically onto the conductor when the wedges are advanced.

Another purpose of the interlock configuration is that it helps insertion of the conductor into the connector during installation. Typically, during installation, the end of the conductor is cut to remove any frayed strands. The end of the conductor usually acquires a slight curvature; usually referred to as "bananaing". The curvature or "bananaing" makes it difficult for the conductor to be inserted into a straight channel, such as the channel along the two opposing wedge conductor groove surfaces 66, 86. The cantilevered bar projection 62 allows the curved end of the conductor to be swept under the bar projections 62 such that the conductor portion under the bar projection is properly aligned in the wedge conductor grooves. With the end under the bar projection 62, the installer can then straighten the conductor by pushing it down into the channel between the wedge conductor groove surfaces 66, 86 using the bar projection 62 as a fulcrum.

As noted above, the connector 10 includes two wedge movement anti-reverse clips 22. In an alternate embodiment, more or less than two wedge movement anti-reverse clips could be provided. The two wedge movement anti-reverse clips are identical to each other. However, in alternate embodiments, the wedge movement anti-reverse clips could be different from each other. The anti-reverse clips 22 are each preferably comprised of a single stamped and formed sheet metal member. However, in alternate embodiments, the anti-reverse clips could be comprised of more than one member, and could be comprised of any suitable type of material(s) formed by any suitable type of manufacturing process.

Figure 6:
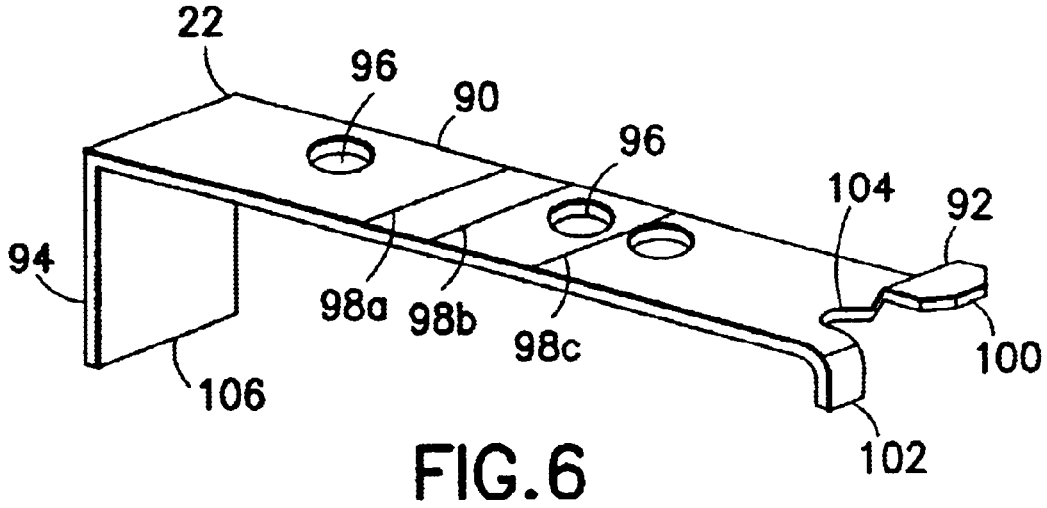
FIG. 6 is a perspective view of the anti-reverse clip shown in FIG. 1.

Referring also to FIG. 6, each of the connector anti-reverse clips 22 generally comprises a main section 90, a front section 92, and a rear section 94. The main section 90 generally comprises mounting holes 96 and markings 98*a*, 98*b*, 98*c* on a top side thereof. The clips 22 are located on the top side of the frame 12 with the mounting posts received in the mounting holes 96. The mounting posts 46 are then deformed to fixedly attach the clips 22 to the frame 12. In an alternate embodiment, any suitable means for mounting the clips 22 to the frame 12 could be provided.

The clip 22 has the markings 98*a*–98*c* which are used as features to indicate the position of the wedges 18, 20 for proper conductor installation. The markings 98 are used as graduation markings corresponding to conductor sizes that the connector 10 is adapted to accommodate. In other words, the anti-reverse clip comprises desired wedge location indicia for multiple types of conductors, the indicia being located on a top side of the clip. During installation of the conductor, the wedges 18, 20 are advanced such that the conductor grooves on the wedges tighten around the conductor. When the wedges have been installed correctly on a particular conductor size, the back of the wedge 18 becomes aligned with the proper conductor graduation on the clip 22. This is a visual indicator to the installer that the connector 10 has been properly installed for a particular size conductor. In an alternate embodiment, the markings 98*a*–98*c* might not be provided, or the connector 10 could be provided with any suitable type of wedge positioning indicia or indicator.

The front section 92 generally comprises a removal tab 100, an anti-reverse tab 102, and a notch 104 therebetween. In alternate embodiments, the front section 92 could comprise alternative or additional sections. The anti-reverse tab 102 and the serrations 68 on the wedge 18 form a wedge anti-reverse mechanism for the connector 10. These components work together to allow the wedges to advance in one direction only; in an outward direction towards the ends of the connector frame 12.

By design, when the conductor is inserted in between one set of wedges, the wedges are moved forward towards the nose or end of the connector. The wedges close applying pressure between the conductor grooves of the wedges and the conductor. As tension is applied axially on the conductor away from the connector, the wedges advance to increasing the pressure. As the wedges move forward the anti-reverse tab 102 of the clip 22 clicks along the successive serrations 68 on the wedge 18. The serrations 68 preferably have a saw tooth serrations design which allows the tab 102 to advance into the next serration, but does not allow the tab 102 to go back to the opposite direction. Thus, this prevents the wedge 18 from reversing and decreasing pressure on the conductor.

The anti-reverse tab 102 extends in a general orthogonal direction relative to the removal tab 100. The removal tab 100 allows a tool such as a slotted screwdriver, to be inserted under the tab 100 for lifting the tab 100 upward. By lifting this removal tab 100 upward, the anti-reverse tab 102 disengages from the wedge serrations 68 on the wedge 18. This allows the wedges 18, 20 to be retracted backward towards the center of the frame 12. This gives the installer the ability to make adjustments during installation. It also gives the ability to remove the connector once installed.

As noted above, the clip 22 comprises a notch 104 located between the two tabs 100, 102. By modifying the length of the notch 104, the spring stiffness of the anti-reverse tab 102 can be changed. The shorter the length of the notch 104, the stiffer the spring stiffness of the anti-reverse tab 102 will be. The longer the length of the notch 104, the less stiff the spring stiffness of the into reverse tab 102 will be. Increasing the stiffness of the anti-reverse tab 102 decreases the ability of the wedges to slide freely in the frame 12. Decreasing the stiffness of the anti-reverse tab 102 increases the ability of the wedges to slide freely in the frame 12. During design of the anti reverse clip 22, with adjustment, the desired "feel" of the sliding wedges can be achieved. In an alternate embodiment, the notch 104 might not be provided.

The rear section 94 of the clip 22 comprises a wedge stop tab 106. The anti-reverse tab and the wedge stop tab extend in a general same direction. The wedge stop tab 106 is provided to prevent the wedges from being retracted beyond a certain point on the frame 12. This can be an important feature to insure that the wedges 18, 20 remain in the frame 12 after assembly at the factory. During factory connector assembly, the wedges 18, 20 are nested together and dropped into the frame 12. The wedges are then spread apart such that the outer lateral surfaces of the wedges are in contact with the outer walls of the frame 12. The wedges are then advanced forward on the wedge grooves of the frame 12 to a point where the bottom side protrusions 54, 56, 76, 78 no longer have the ability to engage with the initial mounting portions 40, 41 of the slots 36, 37 and be removed from the frame 12. The anti-reverse clip 22 is then assembled onto the frame 12 and on top of the wedge 18. The wedge stop tab 106 abuts the rear side 60 of the wedge 18 and permanently prevents the wedge 18 from moving back to a position where the wedges can become disengaged from the frame 12 via the initial mounting portions 40, 41 of the slots 36, 37. The clip 22 is then fastened to the frame 12 thus preventing the wedges 18, 20 from becoming detached from the frame 12.

Figure 7:
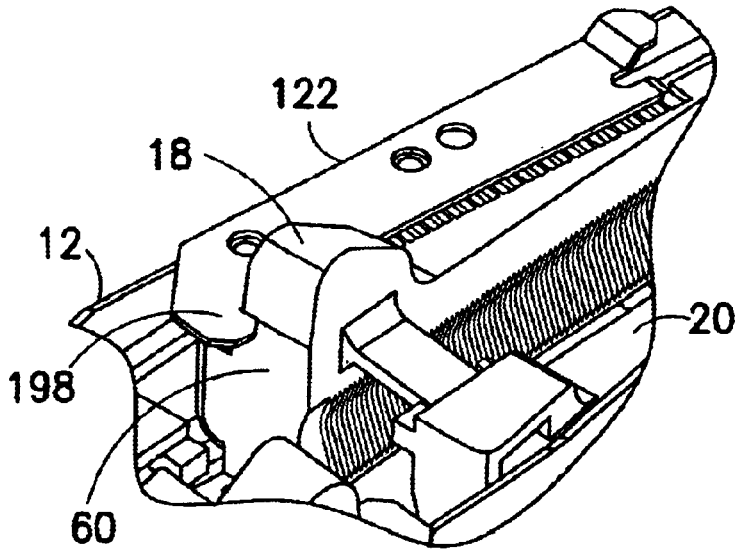
FIG. 7 is a partial perspective view of an alternate embodiment of the connector shown in FIG. 1.
Figure 8:
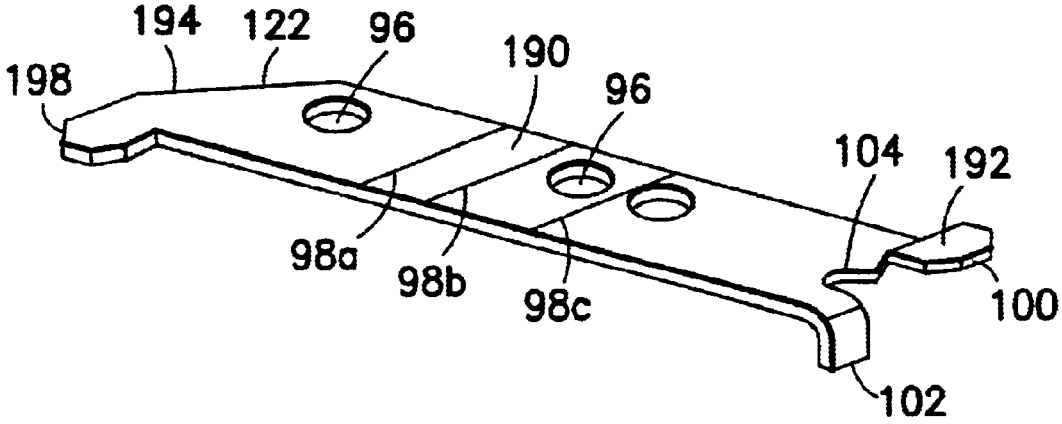
FIG. 8 is a perspective view of the anti-reverse clip shown in FIG. 7.

Referring now also to FIGS. 7 and 8, an alternate embodiment of the present invention will be described. In this embodiment, the connector frame 12 and pairs of wedges 18, 20 are the same as the embodiment shown in FIG. 1. The anti-reverse clip, however, is different. The clip 122 in this embodiment generally comprises a main section 190, a front section 192, and a rear section 194. The main section 190 is the same as the main section 90 of the clip shown in FIG. 6. The main section 190 comprises mounting holes 96 and markings 98*a*–98*c*. The front section 192 is the same as the front section 92 of the clip shown in FIG. 6. The front section 192 comprises a removal tab 100, an anti-reverse tab 102, and a notch 104 therebetween.

The rear section 194 is different than the rear section 94 of the clip shown in FIG. 6. In this embodiment, the rear section 94 comprises a laterally inward projection 198. As shown in FIG. 7, the laterally inward projection 198 is adapted to project behind the rear end 60 of the wedge 18. The projection 198, similar to the tab 106 shown in FIG. 6, limits rearward movement of the wedge 18 on the frame 12. However, the projection 98 can be formed merely by stamping the sheet metal blank which forms the clip 122 and does not require a bending process as would be required with the clip 22 shown in FIG. 6. The design of the clip 122 in FIG. 8 also requires less material than the clip 22 shown in FIG. 6. This can reduce manufacturing costs. In alternate embodiments, any suitable type of anti-reverse clip could be provided.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical conductor splice connector comprising:

a body having a general C-shaped cross section;

conductor contacting wedges movably mounted on the body; and at least one wedge movement anti-reverse clip connected to the body and contacting one of the wedges.

2. An electrical conductor splice connector as in claim 1 wherein the anti-reverse clip is mounted to a top side of the body.

3. An electrical conductor splice connector as in claim 1 wherein the body comprises two wedge receiving areas, the two wedge receiving areas comprising substantially open top sides.

4. An electrical conductor splice connector as in claim 1 wherein at least one of the wedges comprises serrations on a top side which are engaged by a portion of the anti-reverse clip.

5. An electrical conductor splice connector as in claim 1 wherein the conductor contacting wedges comprise a pair of wedges which are connected to each other by a connection for forward and rearward movement on the body in unison with each other.

6. An electrical conductor splice connector as in claim 5 wherein a first one of the wedges comprises a bar slidably extending into a receiving area of a second one of the wedges.

7. An electrical conductor splice connector as in claim 6 wherein the bar is located proximate a top side of the first wedge and the receiving area is located proximate a top side of the second wedge.

8. An electrical conductor splice connector as in claim 7 wherein the first wedge comprises an upwardly extending movement tab which extends out of the body.

9. An electrical conductor splice connector as in claim 1 wherein the anti-reverse clip comprises desired wedge location indicia for multiple types of conductors, the indicia being located on a top side of the clip.

10. An electrical conductor splice connector as in claim 1 wherein the clip comprises a sheet metal member.

11. An electrical conductor splice connector comprising:

a body;

conductor contacting wedges movably mounted on the body; and at least one wedge movement anti-reverse clip connected to the body and contacting one of the wedges wherein the anti-reverse clip comprises a portion with an anti-reverse tab which contacts one of the wedges, and a removal tab located proximate the anti-reverse tab, the removal tab being adapted to be moved away from the body to thereby move the anti-reverse tab.

12. An electrical conductor splice connector as in claim 11 wherein the anti-reverse clip comprises a notch located between the anti-reverse tab and the removal tab.

13. An electrical conductor splice connector as in claim 11 wherein the anti-reverse tab extends in a general orthogonal direction relative to the removal tab.

14. An electrical conductor splice connector comprising:

a body;

conductor contacting wedges movably mounted on the body; and at least one wedge movement anti-reverse clip connected to the body and contacting one of the wedges wherein the anti-reverse clip comprises an anti-reverse tab at a front end of the clip which engages serrations on one of the wedges and a wedge stop tab at a rear end of the clip.

15. An electrical conductor splice connector as in claim 14 wherein the anti-reverse tab and the wedge stop tab extend in a general same direction.

16. An electrical conductor splice connector as in claim 14 wherein the anti-reverse tab and the wedge stop tab extend in general orthogonal directions.

17. An electrical conductor splice connector comprising:

a body having a general C-shaped cross section; and a pair of opposing conductor contacting wedges having bottom surfaces and outer lateral side surfaces slidably located on the body, wherein a first one of the wedges comprises a cantilevered bar at a top portion of the first wedge which slidably extends into a receiving area of a second one of the wedges to interlock forward and reward movement of the pair of wedges with each other.

18. An electrical conductor splice connector as in claim 17 wherein the body comprises two wedge receiving areas having substantially open top sides.

19. An electrical conductor splice connector as in claim 17 wherein the body comprises wedge grooves and the wedges comprise protrusions slidable located in the wedge grooves, and wherein at least one of the wedge grooves comprises a main section and an initial mounting portion located inwardly relative to the main section, and wherein during locating of the pair of wedges on the body the protrusion must be located in the initial mounting portion of the wedge groove before the protrusion can be moved into the main section of the wedge grooves.

20. An electrical conductor splice connector as in claim 17 further comprising at least one wedge movement anti-reverse clip connected to the body and contacting one of the wedges.

21. An electrical conductor splice connector as in claim 20 wherein the anti-reverse clip is mounted to a top side of the body.

22. An electrical conductor splice connector as in claim 21 wherein at least one of the wedges comprises serrations on a top side which are engaged by a portion of the anti-reverse clip.

23. An electrical conductor splice connector as in claim 20 wherein the clip comprises a sheet metal member.

24. An electrical conductor splice connector comprising:

a body;

a pair of opposing conductor contacting wedges having bottom surfaces and outer lateral side surfaces slidably located on the body, wherein a first one of the wedges comprises a cantilevered bar at a top portion of the first wedge which slidably extends into a receiving area of a second one of the wedges to interlock forward and rearward movement of the pair of wedges with each other; and at least one wedge movement anti-reverse clip mounted to a top side of the body and contacting one of the wedges, wherein the anti-reverse clip comprises a portion with an anti-reverse tab which contacts one of the wedges, and a removal tab located proximate the anti-reverse tab, the removal tab being adapted to be moved away from the body to thereby move the anti-reverse tab.

25. An electrical conductor splice connector as in claim 24 wherein the anti-reverse clip comprises a notch located between the anti-reverse tab and the removal tab.

26. An electrical conductor splice connector as in claim 25 wherein the anti-reverse clip further comprises a wedge stop tab at a rear end of the clip.

27. An electrical conductor splice connector comprising;

a body having a general C-shaped cross section; and a pair of interlocked opposing conductor contacting wedges slidably located on the body, wherein the body comprises wedge grooves, wherein the wedges comprise protrusions slidably located in the wedge grooves, wherein at least one of the wedge grooves comprises a main section and an initial mounting portion located inwardly relative to the main section, and wherein during locating of the pair of wedges on the body the protrusion must be located in the initial mounting portion of the wedge groove before the protrusion can be moved into the main section of the wedge groove.

28. An electrical conductor splice connector as in claim 27 further comprising a member attached to a top side of the body, the member comprising a stop tab for limiting reward movement of the wedges on the body.

29. An electrical conductor splice connector as in claim 28 wherein the member further comprises an anti-reverse tab for contacting serrations on a top side one of the wedges.

30. An electrical conductor splice connector as in claim 28 wherein the member comprises a sheet metal member.

31. A method of assembling an electrical conductor splice connector comprising the steps of:

inserting a wedge into a wedge receiving area of a splice connector body having a general C-shaped cross section; and connecting an anti-reversing clip to a top side of the splice connector body, the clip having a anti-reverse tab which projects inward into the wedge receiving area and into contact with the wedge.

32. A method as in claim 31 wherein the step of connecting the anti-reversing clip to the body comprises locating a wedge stop tab of the clip behind a rear end of the wedge to limit reward movement of the wedge on the body.

33. A method as in claim 31 wherein the step of inserting a wedge into the wedge receiving area comprises inserting the wedge with another wedge as a pair of wedges into the wedge receiving area, a portion of one of the wedges extending into a portion of another one of the wedges proximate a top sides of the wedges.

34. A method as in claim 33 wherein the wedge receiving area comprises a substantially open top side and the step of inserting a wedge into the wedge receiving area comprises inserting the pair of wedges through the substantially open top side.

35. A method as in claim 31 wherein the clip comprises a sheet metal member.

36. A method of assembling an electrical conductor splice connector comprising steps of:

inserting a pair of conductor contacting wedges into a wedge receiving area of a splice connector body having a general C-shaped cross section, the wedges having projections which are inserted into initial mounting portions of grooves in the body and subsequently moved into main sections of the grooves; and connecting a clip to the splice connector body, the clip forming a direct barrier to movement of at least one of the wedges such that the projections are prevented from moving back info the initial mounting portions of the grooves and becoming inadvertently disconnected from the splice connector body.

37. A method as in claim 36 wherein the clip comprises a sheet metal member.

* * * * *

UNITED STATES PATENT AND TRADEMARK OFFICE

CERTIFICATE OF CORRECTION

PATENT NO. : 6,773,311 B2
DATED : August 10, 2004
INVENTOR(S) : Mello et al.

It is certified that error appears in the above-identified patent and that said Letters Patent is hereby corrected as shown below:

Column 7,
Line 34, claim 1, should read:

1. An electrical conductor splice connector comprising:

a body having a general C-shaped cross section;

conductor contacting wedges movably mounted on the body; and at least one wedge movement anti-reverse clip connected to the body and contacting one of the wedges wherein the anti-reverse clip comprises a portion with an anti-reverse tab and a removal tab located proximate the anti-reverse tab.

Column 8,
Line 41, claim 17, should read:

17. An electrical conductor splice connector comprising:

a body having a general C-shaped cross section;

a pair of opposing conductor contacting wedges having bottom surfaces and outer lateral side surfaces slidably located on the body, wherein a first one of the wedges comprises a cantilevered bar at a top portion of the first wedge which slidably extends into a receiving area of a second one of the wedges to interlock forward and reward movement of the pair of wedges with each other; and at least one wedge movement anti-reverse clip mounted to a top side of the body and contacting one of the wedges, wherein the anti-reverse clip comprises a portion with an anti-reverse tab which contacts one of the wedges, and a removal tab located proximate the anti-reverse tab.

UNITED STATES PATENT AND TRADEMARK OFFICE

CERTIFICATE OF CORRECTION

PATENT NO. : 6,773,311 B2
DATED : August 10, 2004
INVENTOR(S) : Mello et al.

It is certified that error appears in the above-identified patent and that said Letters Patent is hereby corrected as shown below:

Column 9,
Line 34, claim 27, should read:

27. An electrical conductor splice connector comprising:

a body having a general C-shaped cross section;

a pair of interlocked opposing conductor contacting wedges slidably located on the body, wherein the body comprises wedge grooves, wherein the wedges comprise protrusions slidably located in the wedge grooves, wherein at least one of the wedge grooves comprises a main section and an initial mounting portion located inwardly relative to the main section, and wherein during locating of the pair of wedges on the body the protrusion must be located in the initial mounting portion of the wedge groove before the protrusion can be moved into the main section of the wedge groove;

wherein the connector further comprises an anti-reverse clip member attached to a top side of the body, the member comprising an anti-reverse tab for contacting serrations on a top side of one of the wedges and a removal tab located proximate the anti-reverse tab.

Column 10,
Line 6, claim 31, should read:

31. A method of assembling an electrical conductor splice connector comprising the steps of:

inserting a wedge into a wedge receiving area of a splice connector body having a general C-shaped cross section; and connecting an anti-reversing clip to a top side of the splice connector body, the clip having a anti-reverse tab which projects inward into the wedge receiving area and into contact with the wedge and a removal tab located proximate the anti-reverse tab.

UNITED STATES PATENT AND TRADEMARK OFFICE

CERTIFICATE OF CORRECTION

PATENT NO. : 6,773,311 B2
DATED : August 10, 2004
INVENTOR(S) : Mello et al.

It is certified that error appears in the above-identified patent and that said Letters Patent is hereby corrected as shown below:

Column 10 (cont'd),
Line 34, claim 36, should read:

36. A method of assembling an electrical conductor splice connector comprising steps of:

inserting a pair of conductor contacting wedges into a wedge receiving area of a splice connector body having a general C-shaped cross section, the wedges having projections which are inserted into initial mounting portions of grooves in the body and subsequently moved into main sections of the grooves; and connecting a clip to the splice connector body, the clip forming a direct barrier to movement of at least one of the wedges such that the projections are prevented from moving back into the initial mounting portions of the grooves and becoming inadvertently disconnected from the splice connector body, wherein the clip comprises a portion with an anti-reverse tab which contacts one of the wedges, and a removal tab located proximate the anti-reverse tab.

Claims 20, 21 and 29, should be cancelled.

Signed and Sealed this

Seventh Day of December, 2004

JON W. DUDAS
*Director of the United States Patent and Trademark Office*